US006112781A

United States Patent [19]

Baxter

[11] Patent Number: 6,112,781

[45] Date of Patent: Sep. 5, 2000

[54] METHOD AND APPARATUS FOR FILLING BALLOONS WITH WATER

[76] Inventor: Glen Baxter, 4776 Sunshine Ave., Santa Rosa, Calif. 95409

[21] Appl. No.: 09/016,594

[22] Filed: Jan. 30, 1998

[51] Int. Cl.[7] ..... B65B 1/05

[52] U.S. Cl. ..... 141/391; 141/114; 141/313; 141/314; 141/319; 141/331

[58] Field of Search ..... 141/391, 331–345, 141/114, 313, 314, 10, 319; 446/153, 166, 267, 487, 490; 222/484; D7/700

[56] References Cited

U.S. PATENT DOCUMENTS

D. 241,597 9/1976 Confer et al. ..... 141/331
5,228,488 7/1993 Fletcher ..... 141/331

*Primary Examiner*—David J. Walczak
*Assistant Examiner*—Timothy L. Maust
*Attorney, Agent, or Firm*—Larry D. Johnson

[57] ABSTRACT

An apparatus for filling expandable toy balloons with a liquid such as water includes a body portion defining a central cavity and having a pair of open ends, with the lower end formed into a fitting member for releasable engagement of the neck of a balloon, and the upper end formed into a mouthpiece for the user's mouth. The neck of the balloon to be filled is placed over the fitting member and the entire apparatus (with balloon attached) is then at least partially filled with water by dipping into a body of water. The user then places his mouth on the mouthpiece and exhales into the body portion and central cavity, to displace the water into the balloon until the balloon has been filled with water to the desired level. The filled balloon can then be removed from the fitting, and the neck of the balloon tied off in a knot, so that the water balloon may be used for play.

4 Claims, 3 Drawing Sheets

METHOD AND APPARATUS FOR FILLING BALLOONS WITH WATER

BACKGROUND OF THE INVENTION

1. Field of the Invention

This invention relates generally to toys and accessories therefor, and more specifically to an apparatus for filling toy balloons with a liquid such as water.

2. Description of the Prior Art

Toy balloons are typically made from latex rubber or similar expandable material, and are usually filled with air or other gas for use as a toy or decoration. Alternatively, many users desire to fill their balloons with water or other liquid so they may use them as "water balloons", which can then be thrown to intentionally break or "explode" upon impact with a target as such as the ground, or an unfortunate playmate. It is the process of filling these water balloons with water that is the subject of this invention.

Most users fill a water balloon by expanding the balloon opening (neck) over a sink faucet, hose bib, drinking fountain, or other pressurized water supply fitting. The user then opens the water supply valve so that the pressurized water fills the balloon with water to the desired volume, whereupon the user closes the water supply valve, removes the filled balloon from the fitting, and ties off and seals the neck of the water balloon for play.

However, many play areas do not have access to a supply of water under pressure, making it difficult if not impossible to fill water balloons. For example, while swimming pools, creeks, lakes, oceans, and other bodies of water make ideal locations for water balloon play, it is difficult to fill the balloons with water for lack of a pressurized water supply.

SUMMARY OF THE INVENTION

The method and apparatus for filling water balloons of this invention provides an improved apparatus for filling expandable toy balloons with a liquid such as water. The inventive water balloon filling apparatus includes a body portion defining a central cavity and having a pair of open ends. The first or lower end of the filling apparatus is formed into a fitting member for releasable engagement to the neck portion of a balloon. This fitting member may take the form of one or more circular flanges or barbs. The second or upper end of the filling apparatus is formed into a mouthpiece for the user's mouth.

The inventive filling apparatus may be used in the following manner: The neck of the balloon to be filled is placed (stretched) over the fitting member on the lower end of the apparatus. The entire apparatus (with balloon attached) is then at least partially filled with water by dipping the apparatus into a body of water (such as a bucket, swimming pool, stream, lake, ocean or the like) such that water flows through the mouthpiece in the upper end of the filling apparatus body and into the central cavity. Then, while holding the balloon onto the fitting, the user places his or her mouth on the mouthpiece and exhales into the body portion and central cavity. This exhaled air displaces the water in the central cavity and forces the water through the lower end and fitting and into the balloon to begin to fill the balloon with water. The user then continues exhaling into the mouthpiece until the balloon has been filled with water to the desired level. The filled balloon can then be removed from the fitting member, and the neck of the balloon tied off in a knot or otherwise sealed, so that the water balloon may be used for play.

DETAILED DESCRIPTION OF A PREFERRED EMBODIMENT

Figure 1:
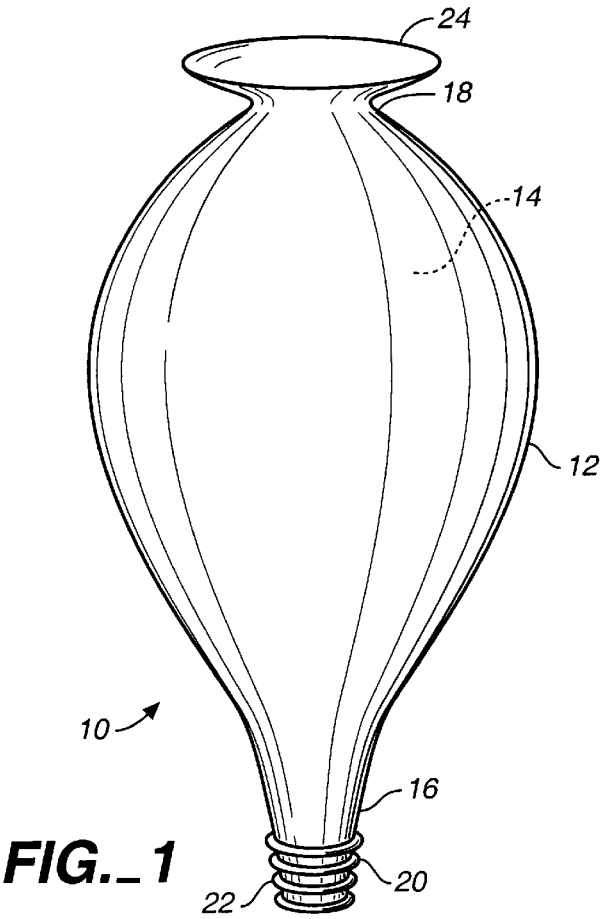
FIG. 1 is a front elevation view of a water balloon filling apparatus of this invention.

FIG. 1 is a front elevation view of a water balloon filling apparatus 10 of this invention. Filling apparatus 10 includes a body portion 12 defining a central cavity 14, and having a lower open end 16 and upper open end 18. Lower open end 16 is preferably formed into a fitting member 20 adapted for releasable engagement with the neck portion of a toy balloon. This fitting member may include one or a plurality of ridges or flanges 22, such as is well known in the art. Upper open end 18 may be formed into a mouthpiece portion 24 of a size and shape to comfortably fit a user's mouth.

The filling apparatus is preferably made of non-toxic, durable plastic material. Alternatively, clay, metal or any other generally rigid, non-permeable material may be used. The body member is preferably wider than the lower and upper open ends, to be able to contain a suitable volume of water in a manageable sized article. The body member is preferably sized so that the central cavity has a capacity of approximately one and-a-half to two and-a-half cups of water, which is believed to be the average size or capacity of most water balloons. The body portion may also include a handle, string or other accessory to enable easier grasping by the user.

Figure 2A:
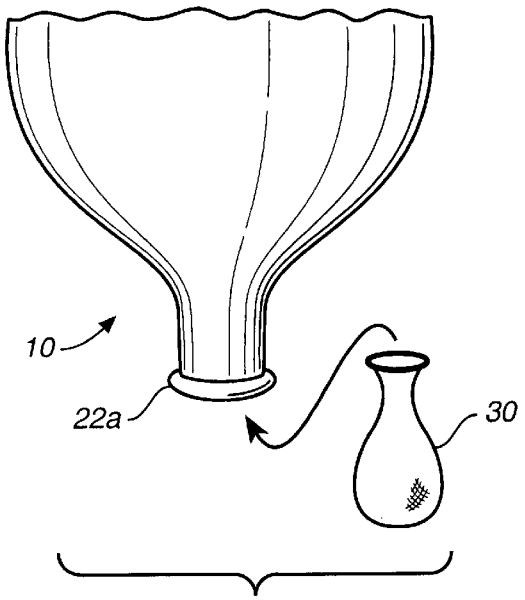
FIG. 2A is a front elevation view of a balloon placed adjacent the fitting member on the lower end of the body of the filling apparatus
Figure 2B:
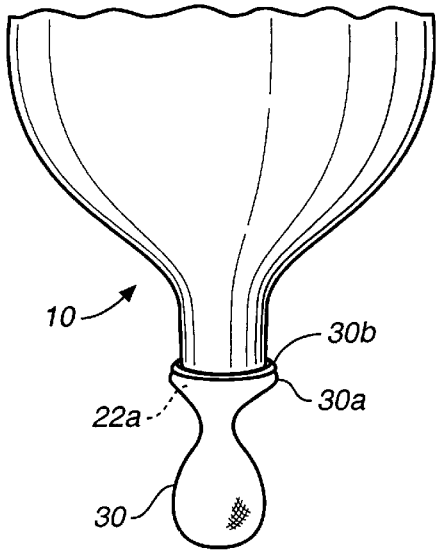
FIG. 2B is a front elevation view of the neck of the balloon having bee laced on the fitting member.

FIG. 2A is a front elevation view of a balloon 30 having been placed adjacent filling apparatus 10, with a single-flange fitting member 22*a*. FIG. 2B illustrates the neck 30*a* of balloon 30 having been stretched over fitting member 22*a*, such that balloon ring 30*b* is captured behind the flange of fitting 22*a*.

Figure 3A:
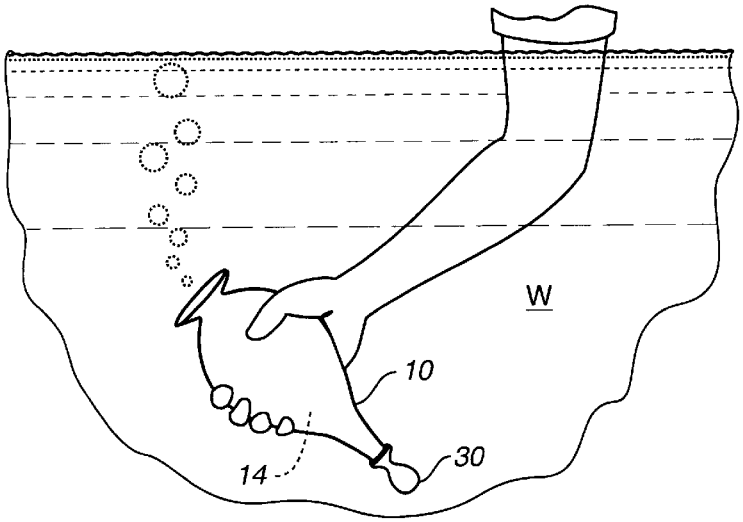
FIG. 3A is a pictorial view of the water balloon filling apparatus (with balloon attached) being submerged in a body of water to fill the central cavity with water.
Figure 3B:
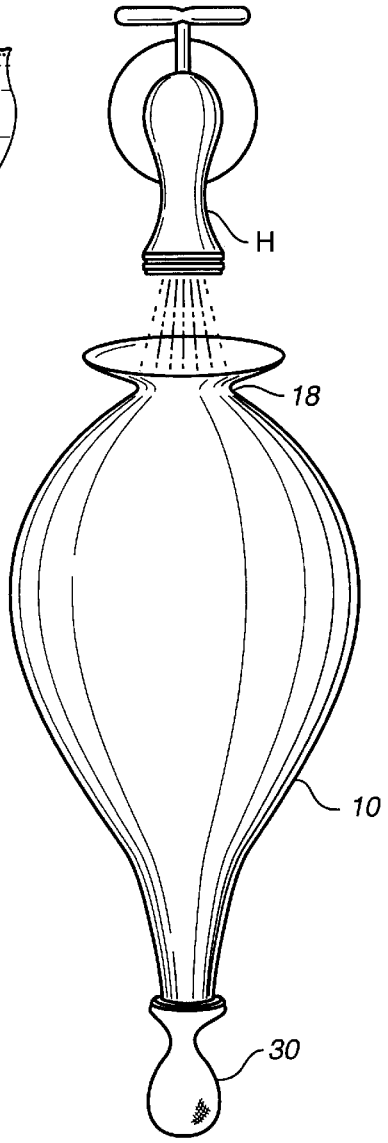
FIG. 3B is a front elevation view of the water balloon filling apparatus (with balloon attached) being filled from a standard hose bib.

FIG. 3A is a pictorial view of the water balloon filling apparatus 10 with balloon 30 attached being submerged in a body of water W to at least partially fill the central cavity 14 with water. Any body of water, even a small bucket or pool, can be utilized. FIG. 3B illustrates the filling apparatus 10 (again with balloon 30 attached) being filled in a more traditional manner, as by placing the open upper end 18 beneath a flow of water from a typical hose bib H.

Figure 4:
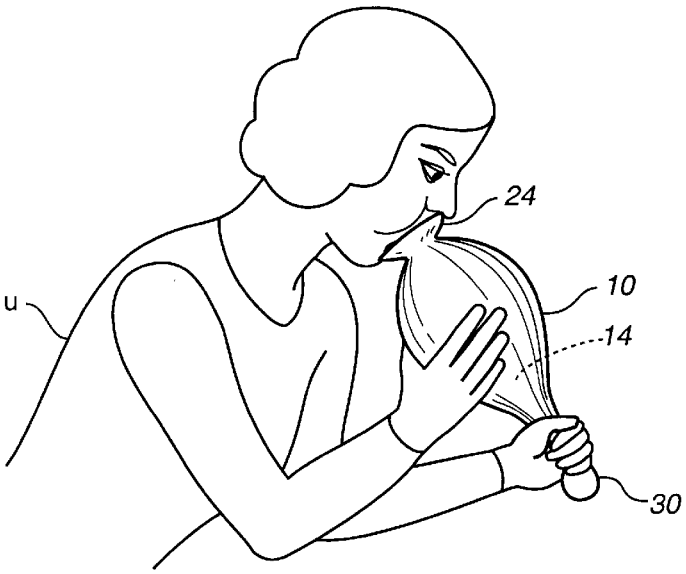
FIG. 4 is a pictorial view of a user placing his mouth on the mouthpiece of the filling apparatus and exhaling to displace water from the central cavity through the lower end and fitting member a into the balloon.

FIG. 4 is a pictorial view of a user U placing his mouth on or in the mouthpiece 24 of the filling apparatus 10, and beginning to exhale to displace water from the central cavity 14 and into the balloon 30.

Figure 5A:
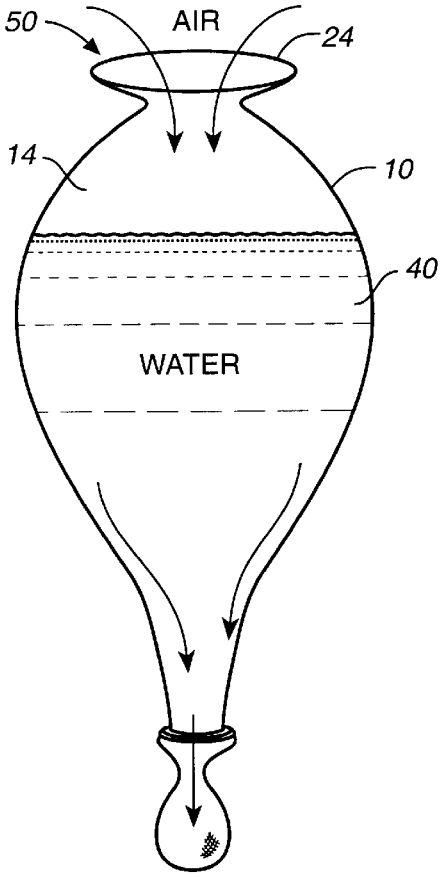
FIG. 5A is a side elevation cross-sectional view illustrating (exhaled) air entering the central cavity of the filling apparatus, and the flow of water from the central cavity into the balloon.
Figure 5B:
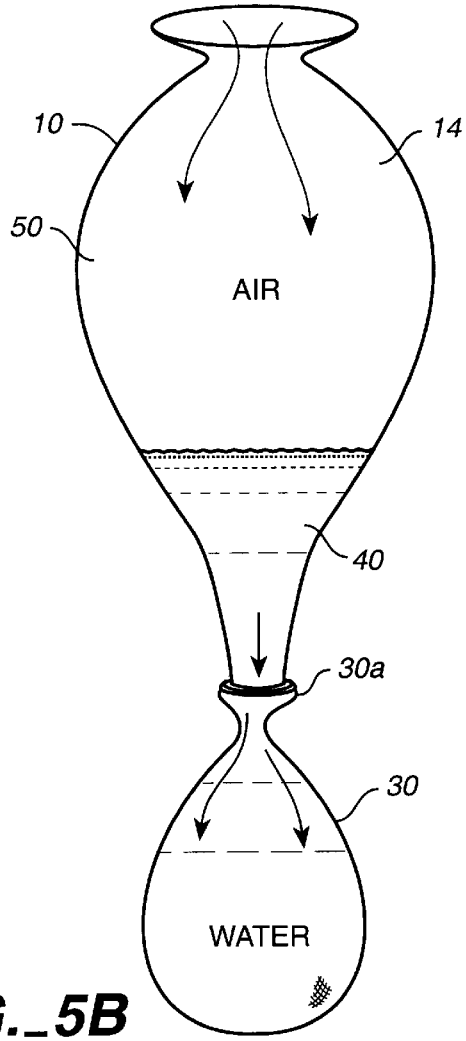
FIG. 5B is a front elevation cross-sectional view illustrating (exhaled) air having displaced at least some portion of the water in the central cavity and into the balloon, with the water balloon now ready for removal and sealing for play.

FIG. 5A is a side elevation cross-sectional view of the filling apparatus 10 partially filled with water 40, with air 50, having been exhaled by the user through the mouthpiece 24 and into the central cavity 14. FIG. 5B illustrates the exhaled air 50 having displaced at least some portion of the water 40 in the central cavity 14, such that water has now filled the balloon 30 to the desired level and capacity. The balloon 30 may now be removed from the filling apparatus 10, the neck 30*a* of the balloon tied in a knot to seal the water within the balloon, and the water balloon used for play.

Figure 6A:
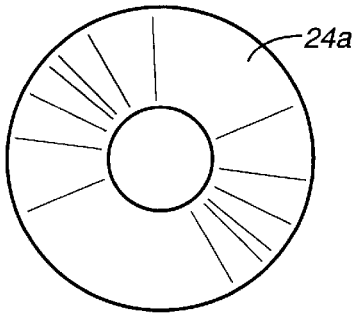
FIG. 6A is a top plan view of a round mouthpiece such as can be used with the water filling apparatus.
Figure 6B:
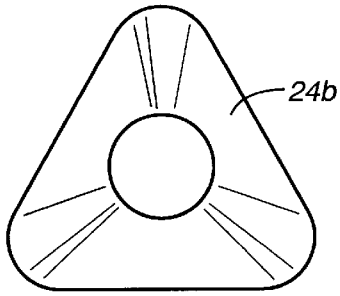
FIG. 6B is a top plan view of a triangular mouthpiece.

FIG. 6A is a top plan view of a round configuration mouthpiece 24*a* that may be a suitable design for many users and applications. FIG. 6B illustrates a triangular configuration mouthpiece 24*b* that may be a better fit for a user's mouth (e.g., this shape may form a better seal with the mouth and face).

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A method for filling expandable balloons with water by a user, the balloons having a neck portion, said method comprising the steps of:

engaging the neck portion of an expandable balloon to a fitting member on a first end of a filling apparatus having a body portion defining a central cavity and having a pair of open ends;

at least partially filling said central cavity of said filling apparatus with water through a second end of said filling apparatus formed into a mouthpiece portion for the user's mouth;

exhaling into said mouthpiece portion to displace the water in said central cavity and force the water through said first end and fitting member and into the balloon to fill the balloon with water to the desired level; and removing the filled balloon from said fitting member and sealing the neck of the balloon so that the water balloon may be used for play.

2. The method for filling expandable balloons with water of claim 1 wherein the step of removing the filled balloon from said fitting member and sealing the neck of the balloon comprises tying the neck of the balloon in a knot.

3. The method for filling expandable balloons with water of claim 1 wherein the step of at least partially filling said central cavity of said filling apparatus with water comprises dipping the apparatus into a body of water.

4. The method for filling expandable balloons with water of claim 1 wherein the step of at least partially filling said central cavity of said filling apparatus with water comprises placing the apparatus beneath a flow of water.

* * * * *